United States Patent [19]

Gorny

[11] 4,139,252

[45] Feb. 13, 1979

[54] CURRENT COLLECTOR WITH A PROTECTIVE SCREEN

[75] Inventor: Rolf D. Gorny, Hilden, Fed. Rep. of Germany

[73] Assignee: U.S. Philips Corporation, New York, N.Y.

[21] Appl. No.: 838,201

[22] Filed: Sep. 30, 1977

[30] Foreign Application Priority Data

Dec. 3, 1976 [NL] Netherlands ..... 7613476

[51] Int. Cl.[2] ..... H01R 7/32; H01R 13/44

[52] U.S. Cl. ..... 339/22 B; 200/51.07; 339/88 R

[58] Field of Search ..... 339/22 R, 22 B, 75 M, 339/88 R; 200/51.07, 51.13

[56] References Cited

U.S. PATENT DOCUMENTS 3,757,063 9/1973 Hart et al. ..... 339/22 B X

FOREIGN PATENT DOCUMENTS 481504 12/1969 Switzerland ..... 339/22 R

*Primary Examiner*—Roy Lake
*Assistant Examiner*—E. F. Desmond
*Attorney, Agent, or Firm*—David R. Treacy

[57] ABSTRACT

A current collector for connection to a current rail having current conductors in its side walls. The collector has a housing from which a coupling member having laterally directed electrical contact fingers projects. An element which screens the contact fingers and provides protection against touching the live parts of the device is rotatably mounted about the coupling member.

2 Claims, 1 Drawing Figure

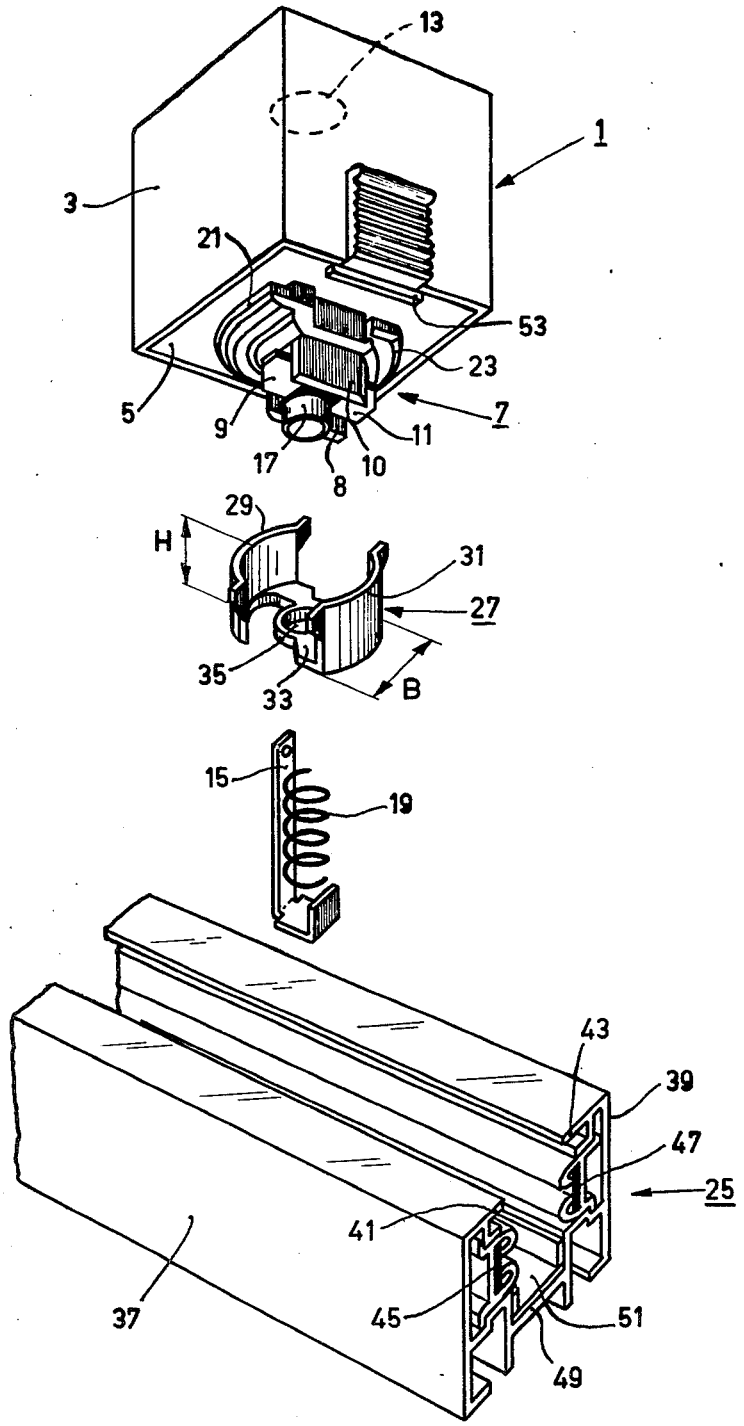
13
1
3
21
53
23
5
9
7
11
17
10
8
29
H
31
27
35
33
B
15
19
43
39
47
25
41
37
45
51
49

CURRENT COLLECTOR WITH A PROTECTIVE SCREEN

BACKGROUND OF THE INVENTION

The invention relates to a current collector for connection to a current rail having two parallel side walls provided with current conductors and more particularly to a collector which has a housing of insulating material with a base plate from which projects a plug-shaped member connected to the housing, and having laterally directed electrical contact fingers. Such a current collector is known from U.S. Pat. No. 3,611,252.

The current collector may be used to connect a luminaire, for example an incandescent lamp luminaire, to a current rail. For that purpose the coupling member is inserted with the contact fingers between the side walls of the current rail after which the housing is turned a quarter of a turn. As a result of this rotation the contact fingers are guided to the current conductors so that an electrical contact is produced between the contact fingers and the current conductors and current collection can take place.

A drawback of the known current collector is that the electrical contact fingers in the operating condition of the device are freely accessible from without. As a result of this the danger exists that a person who gets between the side walls of the current rail with his finger or with an object can contact the live contact fingers, which is absolutely undesired for reasons of safety.

SUMMARY OF THE INVENTION

It is an object of the invention to provide a current collector of the kind mentioned in the preamble, which protects a person inserting the collector from contact with the live parts of the device.

For that purpose the current collector according to the invention has an element which is rotatable about the axis of the coupling member and which screens the contact fingers and which, upon placing the collector on the current rail, is situated between the side walls thereof. The screening element of a device provided on a current rail covers the current rail on the side of the coupling member in such manner that contact from without with the contact fingers is not possible. When the collector is provided or removed, touching of the contact fingers is also made impossible by the screening element.

In a preferred embodiment of the current collector the screening element has two diametrically arranged wall portions extendding along the coupling member. Herewith a very simple and efficacious screening element is obtained which can easily be manufactured. When the coupling member is introduced into the current rail the screening member is oriented so as to fit between the side walls of the current rail. The contact fingers extend at least substantially transversely to the wall portions. When the housing is rotated, so that the contact fingers are coupled electrically to the current conductors, the screening element maintains its originally assumed position with respect to the current rail.

The wall portions of the screening element may be constructed as flat plates, the distance between the plates being at least equal to the distance between the free ends of the contact fingers. The wall portions may also be curved, each wall portion being formed, for example, as a part of the cylinder wall of a circular cylinder the axis of which coincides with the axis of the coupling member and the diameter of the circle of which in the base plate is at least equal to the distance between the free ends of the contact fingers.

The screening element may be manufactured from an insulating material, for example a synthetic resin such as a polycarbonate. The screening element may alternatively be a metal. In the latter case the element is preferably connected to an earth conductor incorporated in the current rail.

BREIF DESCRIPTION OF THE DRAWING

An embodiment of a current collector according to the invention will be described in greater detail with reference to the drawing which is a perspective, partly exploded view of the current collector and a current rail of the type with which the device according to the invention can cooperate.

DESCRIPTION OF THE PREFERRED EMBODIMENT

The current collector 1 according to the invention comprises a box-like housing 3 of synthetic resin, for example, of polycarbonate which is covered by a bottom plate 5 from which projects a plug-shaped coupling member 7. The coupling member 7 comprises two laterally directed electrical contact fingers 9 and 11 which are arranged so as to be resilient in the radial direction. The contact fingers are located between the wall parts 8 and 10 and are connected to terminals in the housing to which an electric cable which enters the housing 3 through an aperture 13 can be connected. The coupling member 7 also includes an earth contact 15 which extends along the wall part 8 and projects beyond the end 17 of the coupling member 7 and contact members 21 and 23 for the mechanical connection of the current collector to a current rail 25. The earth contact 15 can be moved axially against the pressure of a spring 19.

According to the invention a current collector has a screening element 27 of polycarbonate which consists of two parallel wall portions 29 and 31 which are connected together by a connection portion 33 having a central aperture 35, through which aperture 35 extends the cylindrical end 17 of the coupling member 7. The screening element 27 can be rotated relative to the housing 3 about the end 17, the earth contact 15 preventing the screening member 27 from sliding off the end 17. The wall portions 29 and 31 are formed as parts of a cylinder wall, the distances between the portions 29 and 31 measured through the center of the central aperture 35 being at least equal to the distance between the ends of the contact fingers 9 and 11, so that the screening element 27 can surround the contact fingers 9 and 11 when, as described below, the collector is in a condition for inserting into a rail. The height H of the screening element 27 is determined by the distance between the end 17 of the coupling member 7 and the base plate 5. The width B of the screening element 27 depends on the internal width of the current rail 25.

The current rail 25 is formed from extruded aluminum and has two parallel side walls 37 and 39 having facing rims 41 and 43, respectively. The side walls 37 and 39 have current conductors 45 and 47, respectively, embedded in insulating synthetic resin. A metal earth strip 51 is incorporated in the bottom 49 of the current rail 25.

The coupling member 7 of the current collector 1 can be inserted into the slot between the rims 41 and 43 of the current rail 45 when the electrical contact fingers 9 and 11 and the mechanical contact members 21 and 23 point in the longitudinal direction of the current rail and the wall portions 29 and 31 of the screening element 27, viewed in the longitudinal direction of the current rail 25, are positioned one behind the other. If the housing 3 is then turned from this condition through an angle of 90° the contact members 21 and 23 will engage below the rims 41 and 43, respectively, and produce the mechanical coupling, the contact fingers 9 and 11 producing the electrical connection to the current conductors 46 and 47, respectively. Upon turning the housing 3 the screening element 27 maintains its assumed position between the side walls 37 and 39 and thus constitutes a protection against touching the contact fingers 9 and 11.

The housing 3 in this embodiment has a locking slide 53 which prevents the current collector 1 provided on a current rail from working loose. The slide 53 is forced in an extreme position by a spring not shown, the slide 53 projecting beyond the base plate 5. In the assembled condition of the collector 1 to the current rail 25, the slide 53 is in the transverse direction between the side walls 37 and 39 of the current rail 25 so that the housing 3 is locked against rotation. When the collector 1 is to be removed, the slide 53 is moved against the pressure of the spring.

Although a current collector is shown in this example which is suitable for co-operation with a current rail having two conductors, the invention may, of course, also be used in a device which can cooperate with a rail having more than two conductors.

What is claimed is:

1. A current collector, for electrical connection to a current rail having two parallel side walls with current conductors in said side walls, comprising a housing having a base plate, and a coupling member projecting axially in a given direction from the base plate and mechanically connected to the housing, said member having laterally directed electrical contact fingers arranged about the axis to make electrical contact with the current conductors of a current rail into which the collector has been inserted, wherein the collector additionally comprises a screening element mounted to the coupling member for rotation about said axis, said screening element having a bottom and two diametrically opposed wall portions extending from the bottom in a direction opposite said given direction, spaced apart and arranged such that said fingers extend between the wall portions while said collector is in a condition for inserting into the rail; and said wall portions have a width less than the distance between the rail side walls, so that upon insertion of the collector into the rail the wall portions extend between the current conductors, and upon rotation of the coupling member the contact fingers rotate from between said wall portions into a position extending laterally outward toward and into contact with said current conductors.

2. A current collector as claimed in claim 1 wherein said screening element is retained to said coupling member by an earth contact projecting through an opening in the bottom of the element.

* * * * *